US009217304B2

(12) United States Patent
Saltel et al.

(10) Patent No.: US 9,217,304 B2
(45) Date of Patent: Dec. 22, 2015

(54) SUPPORT DEVICE OF EQUIPMENT INSIDE A WELL, A PROCESS FOR FIXING IT AND A PROCESS FOR PLACING SUCH EQUIPMENT

(75) Inventors: Jean-Louis Saltel, Le Rheu (FR); Benjamin Saltel, Cintre (FR); Samuel Thiebaut, Bruz (FR); Gwenaël Tanguy, Pace (FR); Romain Neveu, Rennes (FR)

(73) Assignee: Saltel Industries (FR)

( * ) Notice: Subject to any disclaimer, the term of this patent is extended or adjusted under 35 U.S.C. 154(b) by 429 days.

(21) Appl. No.: 13/700,797

(22) PCT Filed: May 10, 2011

(86) PCT No.: PCT/EP2011/057464

§ 371 (c)(1),
(2), (4) Date: Nov. 29, 2012

(87) PCT Pub. No.: WO2011/151139

PCT Pub. Date: Dec. 8, 2011

(65) Prior Publication Data

US 2013/0146308 A1 Jun. 13, 2013

(30) Foreign Application Priority Data

May 31, 2010 (FR) ..... 10 54205

(51) Int. Cl.
*E21B 23/01* (2006.01)
*E21B 29/10* (2006.01)
*E21B 43/10* (2006.01)

(52) U.S. Cl.
CPC ..... *E21B 23/01* (2013.01); *E21B 29/10* (2013.01); *E21B 43/103* (2013.01)

(58) Field of Classification Search
CPC ..... E21B 43/10; E21B 43/103; E21B 23/01; E21B 29/10
See application file for complete search history.

(56) References Cited

U.S. PATENT DOCUMENTS 2,155,380 A * 4/1939 Bean ..... 166/123
2,345,888 A * 4/1944 Scott ..... 166/208
2,380,612 A * 7/1945 Quintrell ..... 166/140

(Continued)

FOREIGN PATENT DOCUMENTS

GB 2396174 B 10/2005
WO 0118354 A1 3/2001

OTHER PUBLICATIONS

International Search Report for Application No. PCT/EP2011/057464 dated Jun. 6, 2011.

(Continued)

*Primary Examiner* — Robert E Fuller
(74) *Attorney, Agent, or Firm* — Lerner, David, Littenberg, Krumholz & Mentlik, LLP

(57) ABSTRACT

A support device for tubular equipment, such as a liner inside a well, and methods for using the support device, the support device including two elements attached to each other. The two elements are: a) a cylindrical sleeve, made of ductile metal and having an external diameter slightly less than an inner diameter of the well or of a casing inserted into the well; and b) a set of tabs made of hard metal, which are spaced apart from each other and integral with the cylindrical sleeve. The tabs extend downwards from the cylindrical sleeve and an outer wall of the tabs is fitted with a series of notched formations, such as teeth, whereas an inner wall of the tabs has a conical form, the apex of which is turned down.

10 Claims, 5 Drawing Sheets

(56) References Cited

U.S. PATENT DOCUMENTS

| | | | | |
|---|---|---|---|---|
| 3,191,677 | A | 6/1965 | Kinley | |
| 3,253,653 | A * | 5/1966 | Layne, Sr. | 166/63 |
| 4,497,368 | A | 2/1985 | Baugh | |
| 4,523,641 | A | 6/1985 | Manderscheid | |
| 4,580,631 | A * | 4/1986 | Baugh | 166/208 |
| 5,086,845 | A | 2/1992 | Baugh | |
| 7,431,096 | B2 | 10/2008 | Fay | |
| 2009/0065196 | A1 | 3/2009 | Holland et al. | |

OTHER PUBLICATIONS

French Search Report for Application No. FR 1054205 dated Dec. 2, 2010.

* cited by examiner

SUPPORT DEVICE OF EQUIPMENT INSIDE A WELL, A PROCESS FOR FIXING IT AND A PROCESS FOR PLACING SUCH EQUIPMENT

CROSS REFERENCE TO RELATED APPLICATIONS

The present application is a national phase entry under 35 U.S.C. §371 of International Application No. PCT/EP2011/057464, filed on May 10, 2011, published in English, which claims priority from French Patent Application No. 1054205, filed on May 31, 2010, the disclosures of which are incorporated by reference herein.

The present invention relates especially to a process and device for supporting a tubular equipment inside a well (that is, an unlined borehole) or a casing—or tubing—present in the well and fixed in the latter, for example by cementing.

The term "supporting" means as much as holding this equipment by its bottom end as by its upper end.

The invention applies especially to hydrocarbon production wells (petrol or gas) or water-capture wells.

The equipment in question can be a liner, sometimes called "lost column", designed for placing coaxially inside a casing. The liner and the casing are made of steel. The function of the liner is for example to isolate a deteriorated and/or porous part of the casing to render it leakproof.

In relatively current applications, the liner to be put in place has an inner diameter of between around 100 and 200 mm, a wall thickness of the order of 5 to 7 mm, and its length can reach 1 000 m (in this case, it comprises sections of tube fixed end to end).

Its mass is therefore considerable, and may be as much as 30 to 40 tonnes. To support it, it is therefore necessary to have a support device having high mechanical resistance, and fixed extremely solidly and reliably to the surrounding well or casing, which is to take up the liner.

The prior art can be illustrated by documents U.S. Pat. Nos. 4,497,368, 4,523,641, 5,086,845, 7,431,096 and GB-2 396 174.

In this case, these are "liner hangers", that is, devices for holding a liner by its upper end.

In general, these devices make use of a mandrel on the outer wall of which there are mobile sliding feet, the outer face of which is provided with teeth.

The mandrel also carries ramps of variable thickness forming cams, such that by relative shift of the feet along the mandrel the latter engage on the ramps and move radially outwards, the teeth engaging with the wall of the well or of the casing.

This maneuver is generated by a sophisticated hydraulic system.

The aim of the present invention is to propose a support device which is much simpler than those described hereinabove, solid and inexpensive, as well as a process which is easy to execute for installing this device reliably inside a well or a casing.

So, according to a first aspect, this relates to a support device of tubular equipment such as a liner inside a well, that is, an unlined borehole, or a casing present in this well, characterised in that it comprises two elements attached to each other, specifically:

a) a cylindrical sleeve, made of ductile metal, of external diameter slightly less than the inner diameter of the well or of the casing;

b) a set of tabs made of hard metal, spaced apart from each other and overall part of the cylindrical envelope of this sleeve, by extending it downwards following generatrices of the cylindrical sleeve;

the outer wall of these tabs being fitted with a series of notched formations, such as teeth, whereas their inner wall has a conical form, whereof the apex is turned down.

According to advantageous characteristics:

- the outer wall of said sleeve is provided with at least one supple annular joint,
- said notched formations comprise circumferential teeth, of rectangular triangular cross-section,
- the half-angle at the apex of said inner wall is between 5° and 10°.

The invention also relates to a process for fixing such a device, remarkable in that it comprises executing the two following successive steps:

a) radial expansion of the sleeve beyond its elastic limit is caused by means of a packer such as an inflatable bladder, such that its wall is pressed tightly against the inner wall of the well or of the casing;

b) it is deployed by being flexed outwards by means of a rigid tool with a conical or tapered end coming up against the inner wall of the tabs, such that their notched formations penetrate the inner wall of the well or of the casing, whereof the metal is softer than that of the tabs.

Advantageously:

- said tool is constituted by said tubular equipment itself whereof one of the ends has a region whereof the outer wall has a conical profile, complementary to the conical form of the inner wall of said tabs;
- said end is the bottom end, the thickness of the wall diminishing progressively as far as the end of said equipment;
- said outer end is the upper end, said region whereof the outer wall has a conical profile being "interleaved" between two zones of constant, though different, thickness.

Finally, the invention relates to a process for putting in place tubular equipment such as a liner inside a well.

This process consists of:

a) fixing a device according to one of the characteristics hereinabove in a well or a casing, as per the process according to one of the characteristics specified above;

b) making use of a liner comprising at least one portion made of ductile metal, whereof an end part has an outer wall of conical form, complementary to that of the inner wall of the tabs which have been deployed and anchored in the well or the casing, c) axially lowering the liner inside the well or the casing until this portion fits in the device and comes to rest against the inner wall of the tabs, acting as stops and support seats, d) radially expanding some portions of the liner beyond the elastic limit such that they are pressed firmly against the wall of the well or of the casing, isolating the part or parts of the well or of the casing which is or are located between two expanded portions.

Advantageously, said portions are partially pre-expanded.

Preferably, in step d), use is made of tools comprising a packer fixed to the end of a working rod which also bears a member capable of holding the tubular equipment during descent.

Other characteristics and advantages of the invention will emerge from the following detailed description of a preferred embodiment.

In the attached diagrams, the scale according to the radial dimension (that is, perpendicularly to the axis of the well) has been notably oversized with a design relative to the scale according to the longitudinal dimension, with the sole aim of improving clarity.

In these diagrams:

Figure 2:
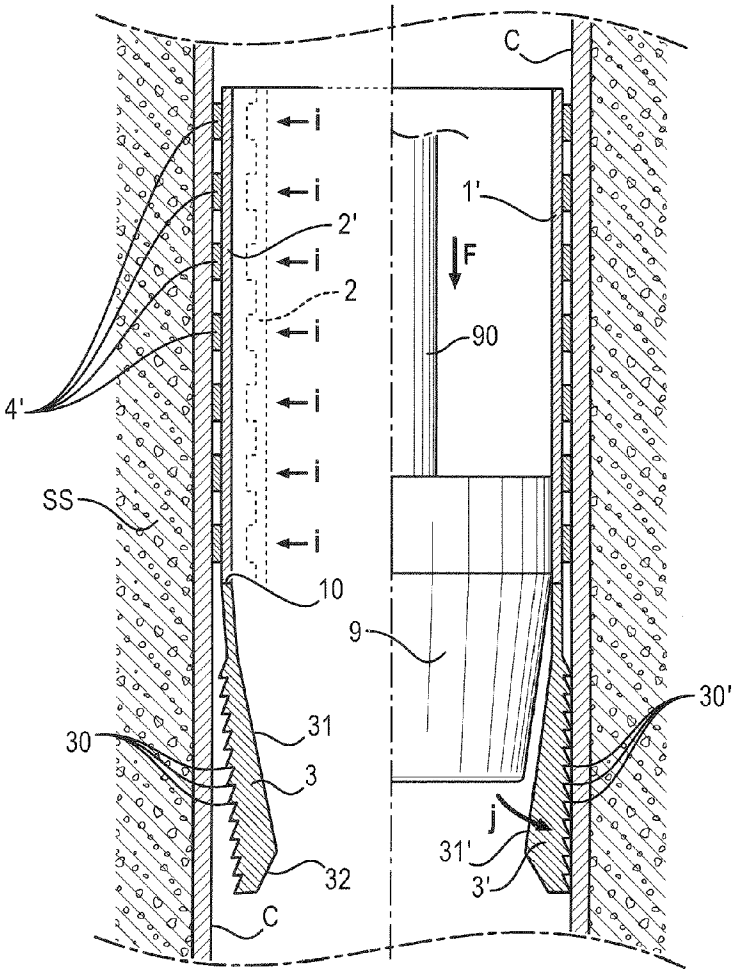
FIG. 2 is a view in axial section showing how fixing this device inside the casing operates, this operation being completed in two successive steps, the half view from the left showing the device on completion of the first step, whereas the half view from the right shows it on completion of the second step.
Figure 1:
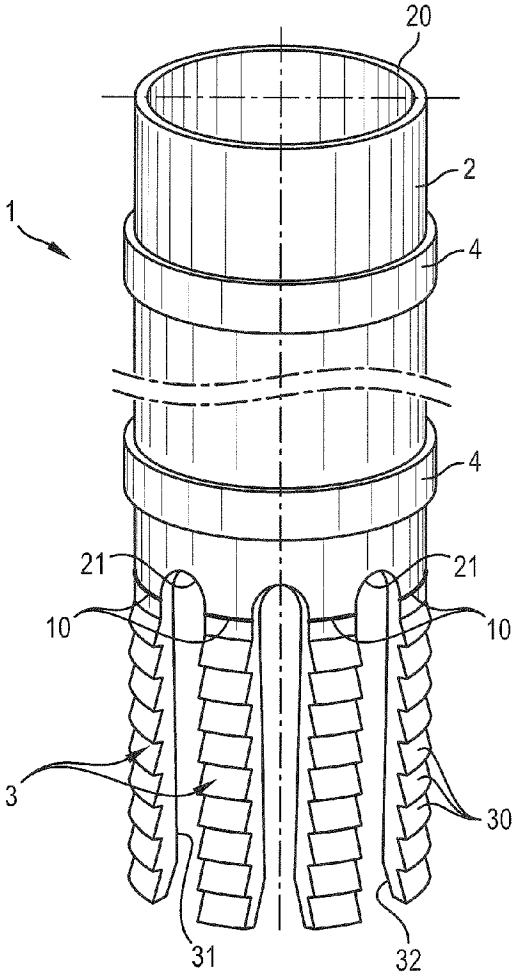
FIG. 1 is a schematic perspective view of the support device, prior to being placed in the casing.

The device 1 shown in FIGS. 1 and 2 comprises two elements attached to each other, specifically—from top to bottom—a cylindrical sleeve 2 made of relatively ductile steel, having a longitudinal and vertical axis, and a set of tabs 3 made of hard steel.

The upper edge 20 of the sleeve 2 is circular, whereas its lower edge is notched, exhibiting semicircular recesses 21 (or notches) or of a reverse U-shape. These recesses are directed parallel to the above longitudinal axis.

These recesses, for example of six or eight, are distributed angularly and evenly over the circumference of the sleeve.

The tabs 3 are fixed, for example by weld lines 10, at the level of the full parts which border the recesses 21. The outer wall of each tab 3 is integral with the cylindrical envelope of the outer wall of the sleeve 2, by extending it downwards following its generatrices.

This outer wall 3 is toothed and is fitted with a series of circumferential teeth 30, of triangular cross-section, sharp-edged.

Their inner wall 31 has, either wholly (over the entire length of the tab), or partially (for example over two thirds of its length, in the lower part) the form of an arc of a trunk of a cone, whereof the apex is turned down, the trunk of the cone consequently flaring upwards.

Advantageously, a bevel 32 is provided in the lower part of this inner wall 31.

The wall thickness of the tab therefore increases continuously and linearly towards the interior and from top to bottom, in this conical portion.

Advantageously, the outer wall of the sleeve 2 is fitted with a series of annular joints 4 made of supple and elastic material, for example rubber, such as adhered rings or o-rings lodged in circumferential grooves.

FIG. 1 illustrates only two of these joints (adhered rings in this case) so as not to clutter this figure.

The overall external diameter of the device 1 is slightly less than the inner diameter of the casing, reference numeral C in FIG. 2, such that it can be lowered freely (without friction) inside the latter, by axial translation from top to bottom, and can be positioned axially at the preferred depth.

Reference numeral SS designates the subsoil surrounding the casing C.

By way of indication, the sleeve 2 has a diameter of between 80 and 350 mm, as a function of the diameter of the well or of the casing in question. Its wall thickness is for example of the order of 5 to 7 mm.

Still way of indication, the length (axial dimension) of the sleeve is between 1 m and 2 m, and that of the tabs between 20 cm and 50 cm.

The device 1 can be placed very simply, for example using a packer which is introduced into the sleeve 2 and is slightly pre-inflated, but enough to be able to support the weight of the device 1 by friction.

This packer (not shown here) can be of any known type, for example in the form of an inflatable bladder with a supple and elastic cylindrical membrane which is fixed at the end of a tubular working rod which shifts the bladder axially inside the casing and introduces high-pressure liquid from the surface to inflate it.

In its left half, FIG. 2 illustrates the first expansion step of the part in the form of a sleeve. Prior to expansion the wall of this sleeve 2 is show in dashed lines. Expansion is done using a packer, not shown here, whereof the active length corresponds substantially to the height of the sleeve such that the packer does not act on the tabs 3.

Its inflation, symbolised by arrows i, causes radial expansion of the sleeve, now designated 2', which is then pressed firmly against the wall of the casing C, and irreversibly due to the fact that expansion occurs in the domain of plastic deformation (beyond the elastic limit of the steel of the sleeve).

This application is done by means of the peripheral joints 4 (now designated 4') which are crushed and compressed, producing efficacious sealing despite possible surface unevenness.

Throughout this first phase, the tabs 3 have not been stressed, other than by radial displacement of their upper zone adjoining the sleeve and are therefore inclined inwards, as is evident in the left half view.

The importance of the notching of the lower portion of the sleeve 2 is to allow homogeneous expansion of the sleeve, including in its low part; in fact, the recesses 21 can open slightly and naturally during this expansion to compensate for the slightest deformability of the wall in the full zones opposite the tabs 3 (at the level of the weld lines 10).

The packer is then deflated and removed.

In a second step, it is possible to deform the tabs using a rigid tool 9 borne by a control rod 90 whereof the descent is symbolised by the arrow F in the right half view.

This tool has an active lower portion of conical form, whereof the conicity and height correspond substantially to those of the zones of wall 31 of the tabs 3.

So, when the tool 9 presses against these zones 31 it forces the tabs to deploy by flexing outwards (reference 3'), via a wedge effect, as symbolised by arrow j, such that their teeth (reference 30') penetrate the softer metal of the wall of the casing C, creating positive anchoring at this level.

The tool is then removed.

It should be noted that during this second step, the device 1 is subjected to high axial force, directed from top to bottom, due to the fact that the tool 9 tends to move the tabs downwards.

But given the considerable adherence between the sleeve 2' and the casing C which results from executing the first phase, the device 1 remains correctly immobilised during the second phase.

The final result therefore is excellent bonding of the device (reference 1') in the casing, as it combines adherence of the part sleeve and positive anchoring of the part tabs.

After fixing, the zones of inner walls 31' of the tabs 3' are integral with a conical envelope (female), adapted to act as support seat to a conical element (male) of complementary form, with which the equipment to be supported is fitted.

Figure 3:
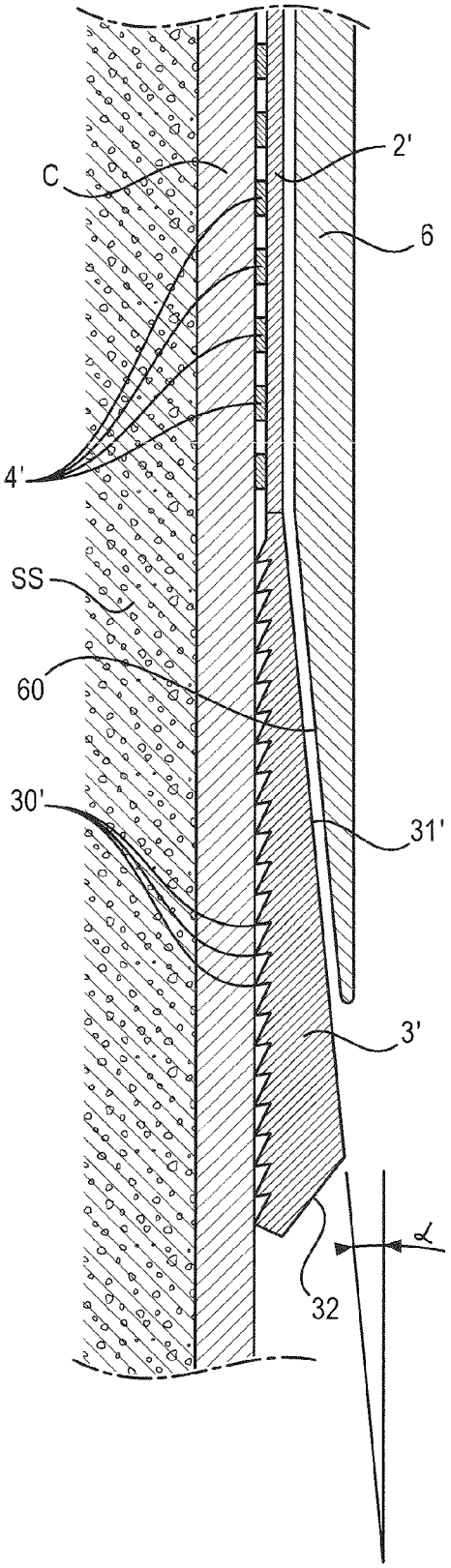
FIG. 3 is a sectional view of the wall of a support device which has been fixed to a casing and which supports the inner end of a liner, the axis of the well being to the right of the figure.

In the illustration of FIG. 3, this element is the lower portion of wall 60 of a liner 6.

As is understood from this figure, the teeth 30' have a rectangular triangular cross-section, whereof the orientation is such that they tend to "bite" into the wall of the casing all the more strongly since the pressure exerted by the wall 60 on its seat 31' is high, causing a phenomenon of beneficial self-locking to support a heavy load.

On the contrary, traction from bottom to top on the tabs tends to disengage the teeth from the wall of the casing, which enables relatively easy extraction of the device, if that proves necessary, using appropriate tools.

By way of indication, the half angle at the apex of the conical walls, designated a in FIG. 3, has a values of between 5 and 10°; it is for example 6°, corresponding to an angle at the apex of value 12°.

In a preferred embodiment, the above mentioned tool 9 will be dispensed with.

In this case, whereas the part in the form of a sleeve has been expanded, as described earlier, and the tabs 3' occupy the non-stressed position of the left part of FIG. 2, the equipment is lowered directly, in this case the liner 6, such that its end of conical form slides on the seat 31' of the teeth 30' by deforming it in the direction of the wall.

This solution, clearly effective, has the advantage of not having to employ additional equipment.

FIGS. 4 to 9 are highly simplified sketches which represent different steps of setting a liner 6 in a casing C using the device 1.

Figure 4:
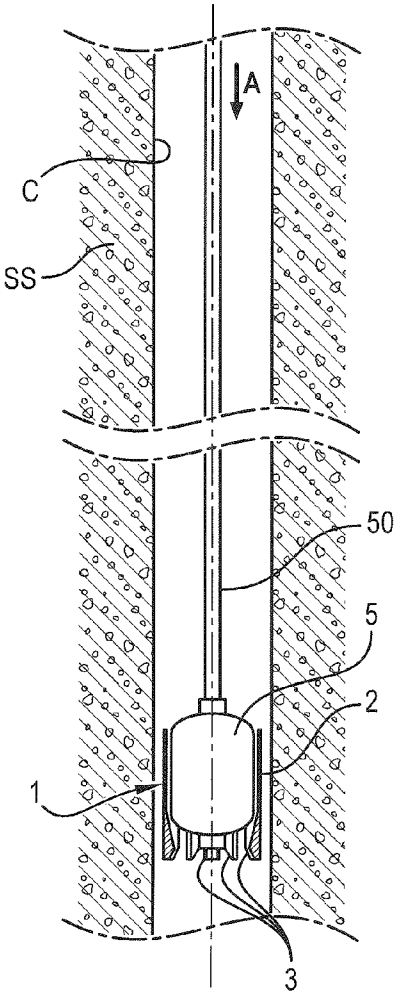

FIG. 4 shows a packer in the form of an inflatable bladder, borne by a control and handling rod 50; the bladder 5 is fitted into the "sleeve" part 2 of the device 1, and is inflated slightly so as to support the latter by simple friction. The assembly is lowered axially (arrow A) to the preferred depth.

Figure 5:
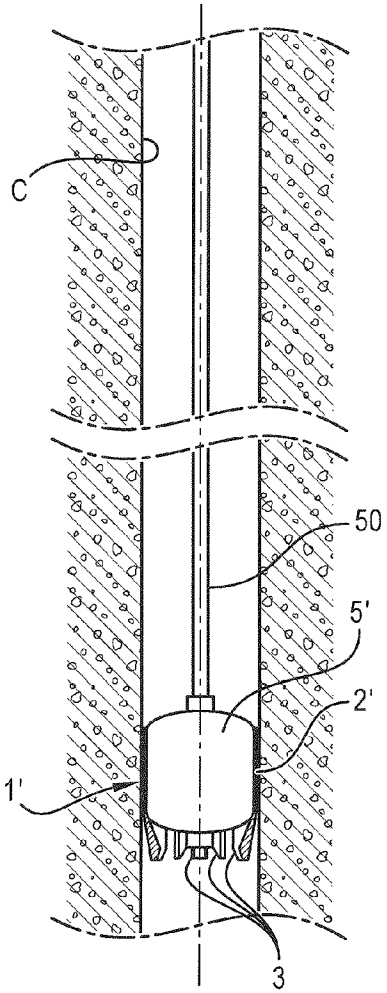

FIG. 5 shows the inflation of the packer (reference (5') which causes radial expansion of the sleeve (reference 2') beyond its limit of elastic deformation.

Next comes the step subsequent of deformation of tabs 3 using a tool with a conical head, a step previously described which is not illustrated here again.

Figure 6:
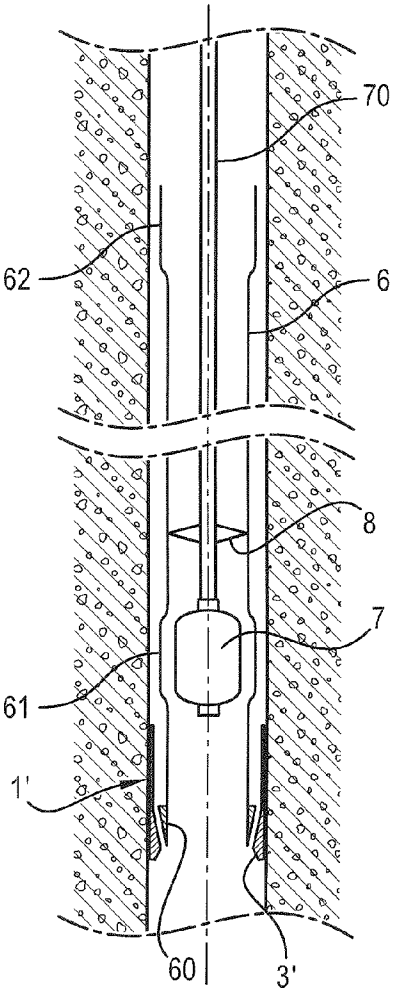
FIGS. 4 to 9 are simplified views which show the successive phases of placing a liner in a casing, in keeping with the process of the invention.

FIG. 6 shows the placing of a liner 6 (the length of which can be considerable) inside the casing.

As for the sleeve 2, the latter has relatively ductile steel portions capable of being expanded radially beyond its limit of elastic deformation.

As seen earlier in reference to FIG. 3, its lower part has a conical outer wall which is adapted to lodge in the conical housing of the tabs 3' which are anchored in the casing.

The liner 6 has two sections which have been previously expanded radially, one 61 located in the low part, the other 62 at the level of the tip of the liner.

These sections have an equal diameter, or even larger than the rest of the liner, but less than the inner diameter of the casing C.

The liner is lowered axially into the casing until its lower part with the conical wall comes to rest against the support device 1'.

This is accomplished by using tools comprising a working rod 70 which is provided at its inner end with a packer 7, such as an inflatable bladder, as well as a holding member 8 (or even several holding members), adapted to support the weight of the liner as it is being placed.

This is a holding member of known type, currently utilised in the field of lifting, acting by friction, with an self-locking effect, against the inner wall of the liner. It consists for example of a pointed and retractable member of the type known by the English term "spear system".

After the liner has been laid, the holding member 8 is inactive, either deliberately or automatically following lifting of the rod 70.

The packer is then positioned opposite the enlarged zone 61, and is inflated to cause radial expansion of this zone beyond its limit of elastic deformation, such that it is pressed firmly and tightly against the inner wall of the casing C.

Figure 7:
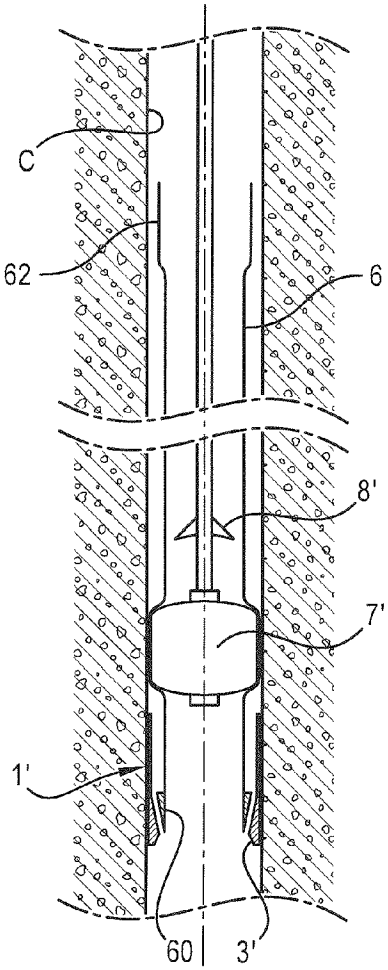

This step is illustrated in FIG. 7, the inflated packer bearing reference numeral 7', whereas the stowed holding member bears reference numeral 8'.

If the axial length of the zone to be expanded is greater than that of the packer, the successive phases are undertaken next, step by step.

Figure 8:
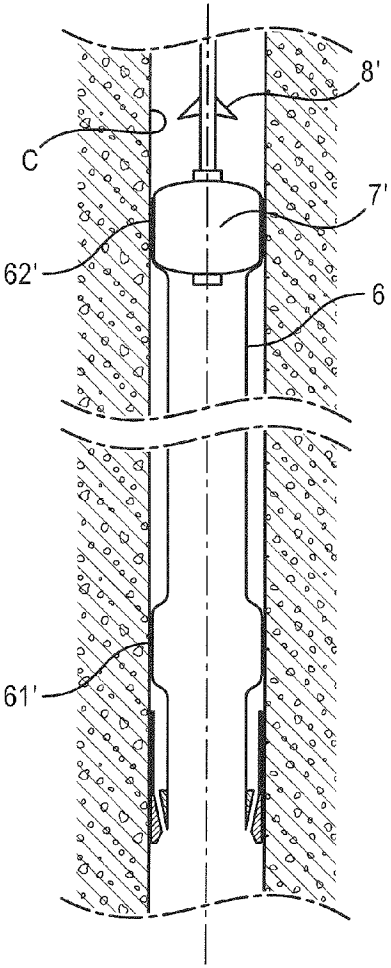

The packer is then deflated, then lifted in view of the expansion of the tip 62, now referenced 62', which operates similarly. This step is illustrated in FIG. 8.

Figure 9:
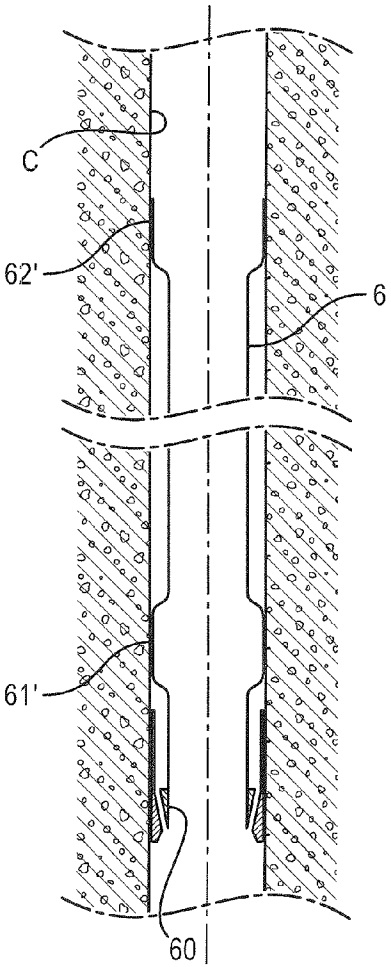

The tool is then removed, leaving in the well a liner 6 which rests on the device 60 and whereof the zone situated between the expanded parts 61' and 62' isolates the casing C from the inner space of the well (FIG. 9).

In the interests of improving sealing at the level of these parts, the pre-expanded zones 61 and 62 are advantageously fitted externally with supple joints which are compressed at the time of expansion (as well as the joints 4 of the sleeve 2).

It should be noted that the same packer could be used to realise expansion of the sleeve 2 of the support and that of the parts 61 and 62 of the liner.

Figure 10:
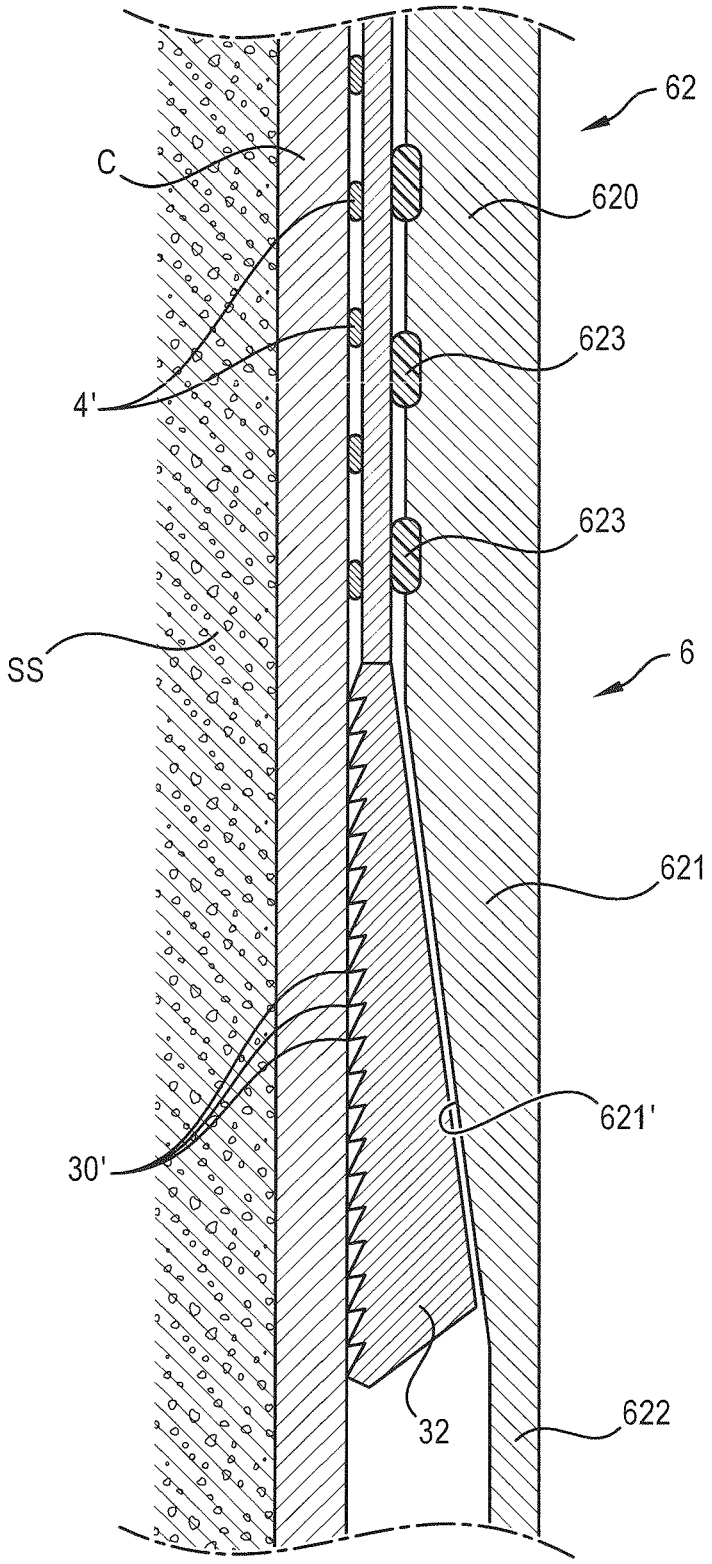
FIG. 10 is a view similar to FIG. 3 of another embodiment of the invention.

In the embodiment of FIG. 10, the upper end 62 of the liner has a region 621 whereof the outer wall has a conical profile, and is interleaved between two regions 620 and 622, of different though constant thickness. The region 620 is that which constitutes the upper end per se of the liner. At this level, it is provided with peripheral annular joints 623.

The liner is lowered into the well by use of an appropriate tool.

The inner diameter of the liner is constant, but its outer diameter, at the level of the region 622 and all along the rest of the liner, is provided to slide along the device 2.

When the outer face 621' of the zone 621 encounters the inner face of the tabs 3, the latter are shifted radially outwards and are locked in the wall of the well.

The two faces are then supported on each other and self-locked. The joints 623, which line the region 620, are crushed against the sleeve 2 and effectively refine the sealing of the device.

The invention claimed is:

1. A process for fixing a support device for tubular equipment inside a well or a casing present in the well, the support device including two elements attached to each other, the support device comprising:

a cylindrical sleeve, made of ductile metal, the cylindrical sleeve having an external diameter less than an inner diameter of the well or of the casing inserted into the well; and a set of tabs made of hard metal, which are spaced apart from each other and integral with the cylindrical sleeve, the tabs extending downwards from the cylindrical sleeve, wherein an outer wall of the tabs is fitted with a series of notched formations, whereas an inner wall of the tabs has a conical form, the apex of which is turned down inside the well or the casing present in the well, wherein said process comprises the successive steps of:

a) radially expanding the sleeve by means of a packer beyond its elastic limit so that a wall of the sleeve is pressed firmly against an inner wall of the well or of the casing;

b) deploying the tabs by means of a rigid tool with a conical or tapered end, which bears against the inner wall of the tabs to flex the tabs outward, such that their notched formations penetrate the inner wall of the well or of the casing, the metal of which is softer than that of the tabs.

2. The process as claimed in claim 1, wherein said tool comprises said tubular equipment itself, one of the ends of which has a region including an outer wall with a conical profile, complementary to the conical form of the inner wall of said tabs.

3. The process as claimed in claim 2, wherein said conical region is at a lower end of said tubular equipment, a thickness of the outer wall of said tubular equipment diminishing progressively as far as a terminal end of said equipment.

4. The process as claimed in claim 2, wherein said conical region is at an upper end of said tubular equipment, said conical region being interleaved between zones of different thickness on the tubular equipment.

5. The process as claimed in claim 1, wherein an outer wall of said cylindrical sleeve of said support device is provided with at least one supple annular joint.

6. The process as claimed in claim 1, wherein said notched formations of said support device comprise circumferential teeth, of rectangular triangular cross section.

7. The process as claimed in claim 1, wherein said inner wall of said tabs of said support device, at said apex, is at a half-angle of between 5° and 10°.

8. A process for placing tubular equipment inside a well or a casing in the well, the process comprising:

a) fixing a device in the well or casing, the device comprising:

a support including two elements attached to each other, one element being a cylindrical sleeve made of ductile metal and having an external diameter less than an inner diameter of the well or of the casing inserted into the well, and the other element being a set of tabs made of hard metal, the tabs being spaced apart from each other and formed integral with the cylindrical sleeve, the tabs extending downwards from the cylindrical sleeve, wherein an outer wall of the tabs is fitted with a series of notched formations, whereas an inner wall of the tabs has a conical form, the apex of which is turned down;

b) providing a liner comprising at least one portion made of ductile metal, whereof one end part of the liner has an outer wall of conical form, complementary to that of the inner wall of the tabs, the tabs being deployed and anchored in the well or the casing;

c) axially lowering the liner inside the well or the casing until its conical portion fits in the device and rests against the inner wall of the tabs, which act as a stop;

d) radially expanding some portions of the liner beyond its elastic limit, such that the liner is applied tightly against a wall of the well or of the casing, thereby isolating the part or parts of the well or of the casing which is or are located between the expanded portions.

9. The process as claimed in claim 8, wherein said portions are partially pre-expanded.

10. The process as claimed in claim 8, wherein step d) is performed using a tool comprising a packer fixed to an end of a working rod, which also carries a member for holding the tubular equipment during descent.

* * * * *